United States Patent [19]

Tanaka et al.

[11] 4,130,749

[45] Dec. 19, 1978

[54] MICROWAVE OVEN

[75] Inventors: Junzo Tanaka, Fujiidera; Masatomo Orita; Chikao Urashima, both of Nara, all of Japan

[73] Assignee: Matsushita Electric Industrial Co., Ltd., Osaka, Japan

[21] Appl. No.: 774,340

[22] Filed: Mar. 4, 1977

[30] Foreign Application Priority Data

| | | | |
|---|---|---|---|
| Mar. 9, 1976 | [JP] | Japan | 51-26426 |
| Mar. 17, 1976 | [JP] | Japan | 51-29491 |
| Mar. 9, 1976 | [JP] | Japan | 51-28884[U] |
| Sep. 2, 1976 | [JP] | Japan | 51-118568[U] |

[51] Int. Cl.[2] ..... H05B 9/06

[52] U.S. Cl. ..... 219/10.55 B

[58] Field of Search ..... 219/10.55 B; 307/141.8

[56] References Cited

U.S. PATENT DOCUMENTS

| | | | |
|---|---|---|---|
| 3,435,247 | 3/1969 | Pfeiffer | 307/141.8 |
| 3,569,656 | 3/1971 | White et al. | 219/10.55 B |
| 3,684,978 | 8/1972 | Otaguro | 219/10.55 B |
| 3,824,365 | 7/1974 | Tapper | 219/10.55 B |
| 3,842,233 | 10/1974 | Lamb | 219/10.55 B |
| 4,011,428 | 3/1977 | Fosnough et al. | 219/10.55 B |
| 4,028,517 | 6/1977 | Tanaka et al. | 219/10.55 B |

FOREIGN PATENT DOCUMENTS 5011046 4/1975 Japan.

*Primary Examiner*—J. V. Truhe
*Assistant Examiner*—B. Roskoski
*Attorney, Agent, or Firm*—Cushman, Darby & Cushman

[57] ABSTRACT

A microwave oven is provided with an automatic timer-controlled output power controlling system, the microwave oven comprising a microwave generator capable of generating a larger output power and a smaller output power, a first timer means which sets a first time period of generating said larger output power, a second timer means which sets a second time period of generating said smaller output power and an output controlling means which controls said microwave generator so as to generates the larger output power for said first time period and subsequently the smaller output power for said second time period.

9 Claims, 4 Drawing Figures

(b)

MICROWAVE OVEN

BACKGROUND OF THE INVENTION

The present invention relates to a microwave oven capable of automatically changing its microwave output power in accordance with desired time schedule selected for the kind and amount of the cooking, so that delicate cooking such as stewing can be made easily and safely without boiling over or scorching.

Microwave ovens with provisions for changing microwave power output between two or more levels are known. In such known microwave ovens, the changing of power output is effected by switching capacitors in a voltagedoubler rectifier circuit for supplying the power to the magnetron or by intermittently switching the microwave oscillator on and off at a preset alternating rate by means of thyristors or other semiconductor switches. However, such microwave ovens are not optimum for cooking stews and soups or the like where relatively long periods of simmering at a constant temperature are required.

For stewing, it is desirable first apply an intensive heating for a short time period, for instance, 20 minutes, and then simmer for a longer time period keeping the cooked matter at around 90° C. In the conventional microwave oven, it is necessary manually to switch the circuit so as to lower the microwave output, and then again manually to switch the circuit off after the long time period, for instance 2 hours.

SUMMARY OF THE INVENTION

The purpose of the present invention is to provide an improved microwave oven wherein the microwave level can be large for a first preset short time period, and then, upon completion of the first preset short time period, can be lowered a small output level which continues for a preset long time period.

It is also the purpose of the present invention to provide a microwave oven wherein the time period for the larger output and the time period for the small output can be selected independently from each other in order to attain best stewing effect for various kinds of cooking and for various amounts of food.

DETAILED DESCRIPTION OF THE INVENTION

Figure 1:
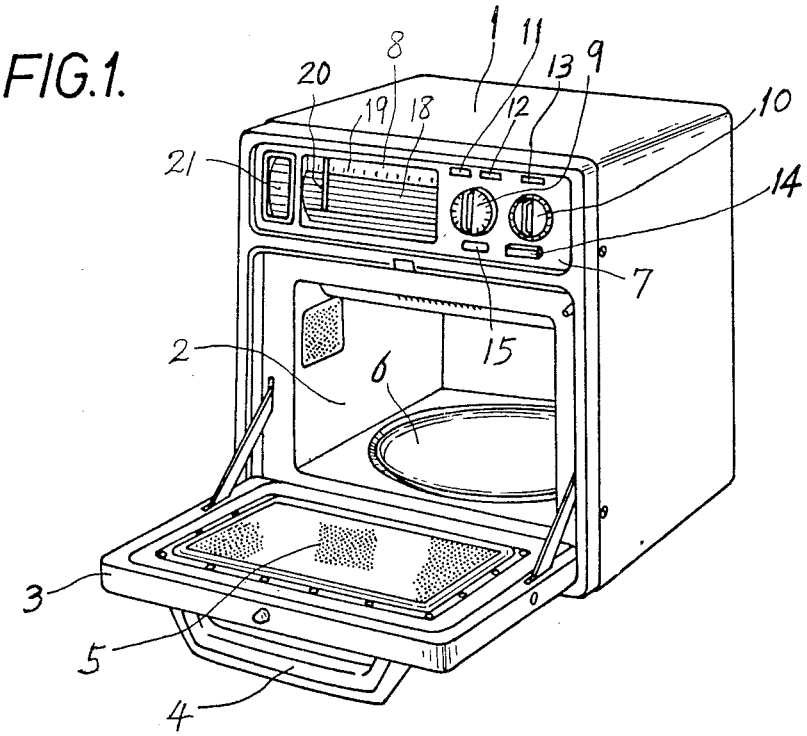
FIG. 1 is a perspective view of the microwave oven of the present invention.

One example of the microwave oven embodying the present invention is shown in FIG. 1: A body 1 includes heating chamber 2, having a door 3, which has a door handle 4, a metal shielding frame 3 and a metal net 5 preventing shielding microwave leakage while at the same time providing visual access therethrough. A turning tray 6 is disposed on the floor of the heating chamber 2. A control panel 7, disposed on the body 1, included: a dial 8, a knob 9 of a first timer, a knob 10 of a second timer, indication lamps 11, 12, 13 and 15, start switch 14, and a cylindrical handle 21 linked with a dial cylinder 18 of the dial 8.

Figure 2:
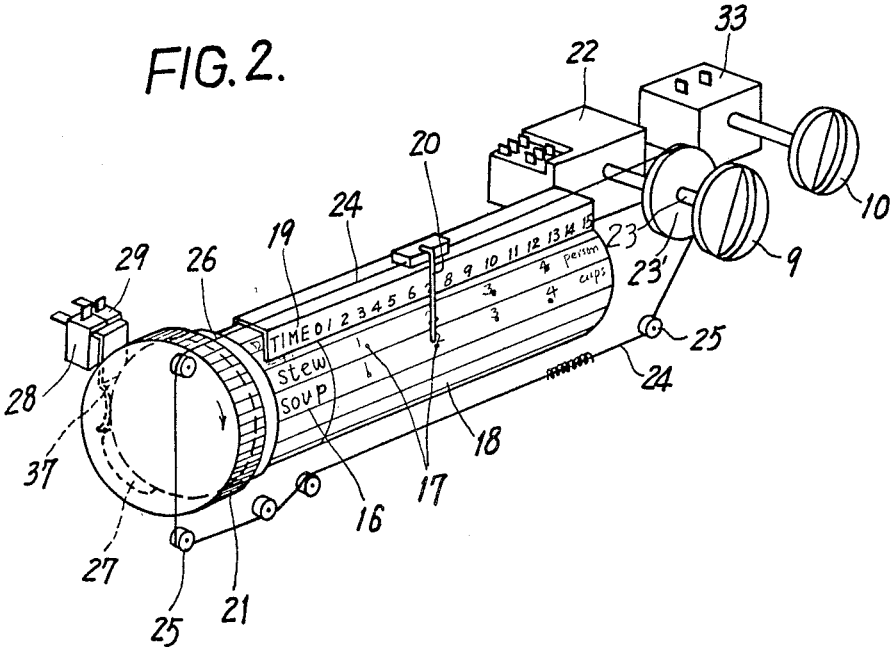
FIG. 2 is a perspective view of the dial part of the microwave oven of FIG. 1.

The mechanical structure of the dial 8 and the related parts is shown in FIG. 2. The dial cylinder 18 is pivoted by a shaft (not shown) so as to be revolved around its axis by manually turning the cylindrical handle 21. The dial cylinder 18 has indications 16 of kinds of food arranged along its circumferential position and indications 17 of number or quantity of each food or number of person served in the direction parallel to the axis. A time graduation plate 19 is fixedly disposed by a frame (not shown). A pointing arm 20 is disposed so as to slide in the axial direction of the dial cylinder 18 by known means (not shown) and is linked with a string 24 which is guided by guide wheels 25 and driven by a driving wheel 23' fixed to the shaft 23 of the knob 9 of the first timer 22. The knob 10 is for setting the second timer 33. The dial cylinder 18 has a drum 26 which is fixed thereto and has a cam-detent 27 for pressing a lever 37 of interlocked cam-switches 28 and 29.

The first timer 22 is for setting a shorter time, for instance up to 10 to 20 minutes, for a larger microwave output. The second timer 33 is for setting a longer time, for instance up to 3 hours for a smaller microwave output.

Figure 3:
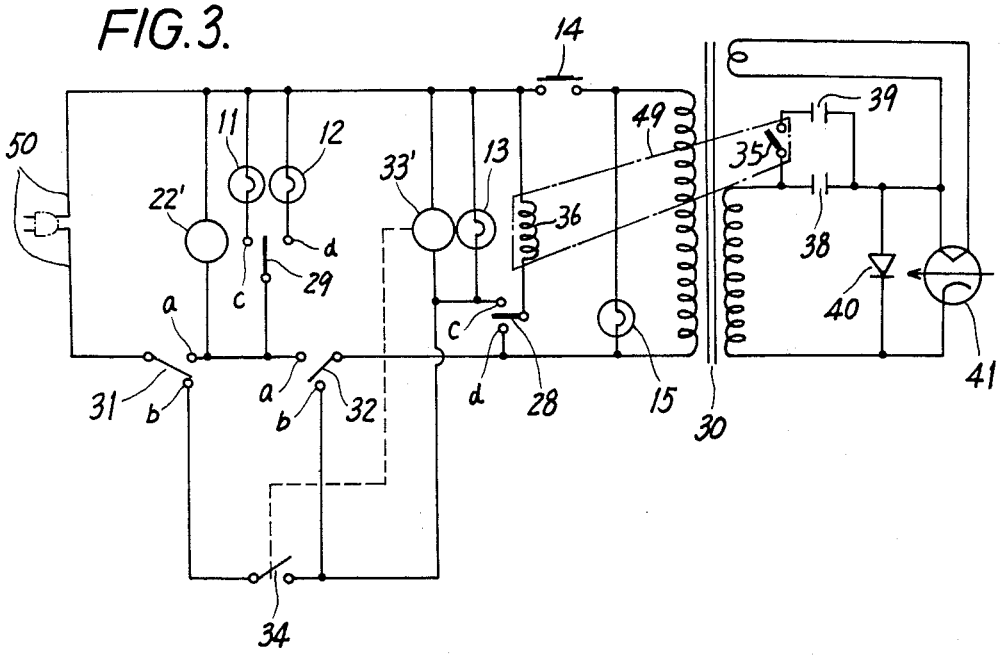
FIG. 3 is a circuit diagram of the microwave oven of FIG. 1, FIGS. 4, (a) and (b) are time charts of the temperature of the cooked food and the microwave output power of the microwave oven of FIG. 1, respectively.

The circuit diagram of the microwave oven of the present invention is shown in FIG. 3, wherein a primary coil of a power transformer 30 is connected across a pair of A.C. power lines 50 through a normal-off contact "a" of a first change-over switch 31 and a normal-off contact "a" of a second change-over switch 32, and through the start switch 14. A diode 40 and a capacitor 38 are connected in series across a high voltage secondary coil of the transformer 30. The anode and the cathode of a magnetron 41 are connected to the cathode and the anode of the diode 40, and an additional capacitor 39 is connected in parallel with the capacitor 38 through a switch 35 of a relay 49. A motor 22' of the first timer 22 is connected across said A.C. power lines 50 through the normal-off contact "a" of the first change-over switch 31. A motor 33' of the second timer 33 is connected across said A.C. power line 50 through a normal-on contact "b" of the change-over switch 31 and through the normal-off switch 34 of the second timer 33. Junction point between the normal-off switch 34 and the motor 33' is connected to a normal-on contact "b" of the second change-over switch 32.

Indication lamps 11 and 12 are connected in parallel with the motor 22' of the first timer switch 22 through a normal-off contact "c" and through a normal-on contact "d", respectively, of the interlocked cam-switch 29. Indication lamp 13 is connected in parallel with the motor 33' of the second timer 33. Coil 36 of the relay 49 is connected in parallel with said motor 33' of the second timer 33 through a normal-off contact "c" of the interlocked cam-switch 28. Normal-on contact "d" of the interlocked cam-switch 28 connects the coil 36 in parallel with the primary coil of the power transformer 30. The interlocked cam-switches 28 and 29 are changed over by non-pressing of the lever 37 by the cam-detent 27 to their normal-off contacts "c" when normal cooking and stew or soup cookings are selected by manually turning the handle 21, hence the dial cylinder 18, and to their normal-on contacts "d" when defrosting and egg cookings are selected, since the lever 37 is pushed by the cam-dent 27. In the abovementioned constitution, the relay 36 and the additional capacitor 39 form an output controlling circuit. The transformer 30, capacitor 38, diode 40 and the magnetron 41 together constitute a microwave generator which oscillates microwave when energized.

The operation is as follows:

First, a desired kind of cooking is selected among the indications of the dial cylinder 18 in a manner that the indication of the desired cooking is present at a specified position of the dial window, for instance, immediately under the time graduation plate 19. Then, on the lengthwise part under the time graduation plate 19 of the dial cylinder 18, an amount of cooking (or number of persons to serve) is indicated.

When normal cooking operation, such as of potatoes, or cakes is selected by the dial cylinder 18 the drum 26 is in a position that the detent 27 is free from the lever 37, and therefore the interlocked cam-switches 28 and 29 are thrown on their sides of normal-off contact "c". Under such state the first timer switch 22 is set for a desired time period or a desired amount (or number of persons to serve) on the indication of the dial cylinder 18, by turning the first knob 9. Resultantly, the change-over switches 31 and 32 are thrown on the sides of the contact "a". Therefore, by closing the start switch 14, the motor 22' of the first timer 22 turns for the set time period, simultaneously lighting the indication lamp 11. Then by the current through the normal-off contacts "a" of the change-over switches 31 and 32, the transformer 30 is energized during the set time period. Since the relay coil 49 is not energized at this time, the switch 35 is closed thereby making the magnetron 41 to generate the higher output for the time period set by the first timer switch 22.

When a low power operation, for egg cooking defrosting are selected by turning the dial cylinder 18, the drum 26 is in a position such that the detent 27 pushes the lever 37, and therefore the interlocked cam-switches 28 and 29 are thrown on their side of normal-on contact "d". When the timer 22 is set for a desired time period by setting a first knob 9, then the change-over switches 31 and 32 are thrown on their sides of the contact "a".

Therefore, the motor 22' of the first timer 22 turns, from the setting for the set time period, and hence the transformer 30 and the relay 49 are energized for the same period. Therefore, the switch 35 opens lowering the rectified voltage and the magnetron 41 generates microwave output at the smaller output power rate.

When a "stewing cooking operation", involving simmering for of stews or soups is selected by turning a dial cylinder 18, the drum 26 is in the position such that the detent 27 is free from the lever 37, and therefore the interlocked cam-switches 28 and 29 are thrown on their sides of the normal-off contact "c". Under such state, when the first timer 22 is set for a desired first time period for larger microwave output by setting the first knob 9, then the change-over switches 31 and 32 of the first timer 22 are thrown on the sides of the contact "a". Also, the second timer switch 34 is set by setting the second knob 10, for a desired second time period for subsequent stew cooking with smaller microwave output. By the setting action, the normal off switch 34 of the second timer 33 remains closed until completion of the set second time of the second timer 33. The motor 33' of the second timer 33 starts to revolve upon changing-over of the switches 31 and 32, namely upon completion of the first set time of the first timer 22.

Thus, by closing the start switch 14, the motor 22' of the first timer 22 is energized to turn for the set first time period, simultaneously lighting the indication lamp 11. During the first time period, the switches 31 and 32 are thrown to the contact "a" disconnecting the circuit of the switch 34, and therefore, the motor 33' and the coil 36 are not energized. Then, upon completion of the first time period, the change-over switches 31, 32 are changed over to their sides of the contact "b," thereby deenergizing the first motor 22' and the indication lamp 11, and energizing the second motor 33', the indication lamp 13, the power transformer 30 and the relay coil 36. Therefore, the switch 35 is opened, thereby disconnecting the additional capacitor 39 and lowering the rectified high voltage for the magnetron 41. Accordingly, the microwave output power is lowered. When the second time is completed, the normal-off switch 34 is restored to be open and disconnects the whole circuit parts from the A.C. lines 50.

By setting the first time period in the first timer 22 to be, for instance, 10 to 20 minutes for larger microwave output of 600 watts and the second time period set by the second timer 33 to be, for instance, 1 to 2 hours for smaller microwave output of 180 watts, a stewing is made in such a manner that during the first time period by the larger microwave output the stewed food becomes heated to about 90° C., and subsequently for the second time period by the smaller microwave output the stewed food is kept heated at about 90° C. Thus, a desirable simmering operation is effected.

Figure 4:
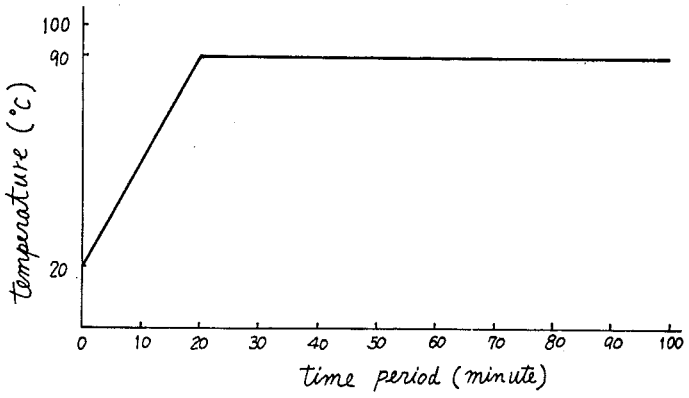
Figure 4:
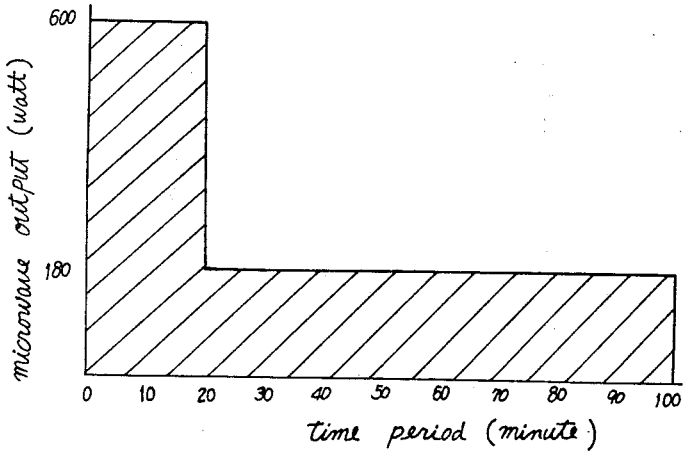

One example of cooking a white stew is made as follows: Cooking materials of the white stew for four persons (about 1300 gr.) are cooked in the microwave oven of the present invention. The stew is made by heating with the larger microwave output of 600 watts for the first time period of 20 minutes and subsequently, with the smaller microwave output of 180 watts for the second time period of 80 minutes as shown by the graph (b) of FIG. 4. By the stronger heating during the first time period, the temperature rises to 90° C. as shown in FIG. 4(a), and then during the subsequent second time period the temperature of 90° C. is maintained by the weaker heating. Since the stew is kept at a high constant temperature for a desired long time period without boiling over, meat and vegetables in the stew become tender since stew juice sufficiently diffuses into them.

In the present invention, by modifying the relay 49 and its contact 35 of FIG. 3 into a gear-reduction motor and a rotary switch to be slowly driven by the gear-reduction motor, the rotary switch being connected so as sequentially to disconnect a number of the additional capacitors one by one, other kinds of delicate cooking can be made.

Furthermore, a modification of the rotary switch and the additional capacitors into a means to continuously changing the microwave output power level can be made within the scope of the present invention by utilizing known art.

For the timers 33 and or 22, known electronic timer circuit or known LSI timer device can be employed.

By means of the indication lamps 11, 12, 13 and 15, operations of normal cooking (including a reheating), defrosting/egg cooking, stew cooking and oscillation of the microwave generator, respectively are indicated. By selecting the same colors for the indication lamps 11 and 13 with the knobs 9 and 10, respectively the kinds of heating (the larger power or the smaller power) at the present time and the remaining time of the heating of that kind can be easily observed.

Since the change-over switches 28 and 29 are interlocked with the selection of cooking on the dial cylinder 18, even without technical knowledge of the electronic circuit, any person can well select a suitable intensity of the microwave output power and suitable time period of heating, for desired kind of cooking and desired number of persons.

Namely, for defrosting a frozen food and for egg cooking, the smaller microwave output is automatically selected by the function of the change-over switches 28 and 29, only by handling the handle 21 in a manner to place the indication of the defrosting and egg cooking of the dial at a specified part of dial window.

If a long time period cooking with a small microwave output power is necessary, by setting both of the first and the second timer, under the dial selection of egg cooking or the like the time period of the sum of the set time periods of both timers is obtainable.

If such an defrosting/egg cooking operation is desired to be made by only setting the time period with the second timer 33 without setting the first timer 22, then the change over switches 28 and 29 should be permanently thrown on their sides of contact "c". The lamps 12 can be dispensed with in such connection.

The advantages of the present invention is as follows:

(a) Conventional stewing on a gas range is likely to cause scorching unless periodically stirred since heating is made through the bottom of the pan. However, according to the present invention the heating is made directly to the inside of the wet food material, and hence does on scorch on the pan. Therefore, there is no need of periodical stirring.

(b) In the gas range, it is difficult to precisely control the heating output. Especially, an automatic control of the flame size by a timer is difficult and dangerous, since small gas flames are likely to extinguish. However, according to the present invention, a precise microwave output control to any desired small power output can be made easily and safely.

(c) Since the microwave heating heats the food from inside, stew cooking can be effected efficiently with respect to heat energy. Especially, in the heating with smaller output during the second time period, the microwave output can be made very small, since the heating during the second time period is only for keeping the food at a specific temperature such as 80° or 90° with efficient heating of the food from inside thereof. Therefore the total energy consumed for the stew cooking is very small.

What is claimed is:

1. A microwave oven of the type including a heating chamber and means for the closing thereof;

a microwave generator for generating microwave energy inside said heating chamber, output controlling means for changing the microwave power output level of said microwave generator, and timer means, cooperating with said output controlling means, and adapted to cooperate with a power supply, for selectively applying power to said microwave generator, wherein:

said timer means comprises:

a first timer motor for defining a first time period;

first and second change-over switches, each having, a pole and first and second contacts and both responsive to said first timer motor, the pole of said first change-over switch being adapted for connection to said power source, said second contact of said first change-over switch being connected to said first timer motor and said second change-over switch second contact, respectively, and said second change-over switch pole being coupled to said microwave generator, selectively connecting, thereby, said first timer motor and said microwave generator to said power source;

a second timing motor connected to said second change-over switch first contact;

a normally off switch coupling said respective first and second change-over switch first contacts, said normally off switch being responsive to said second timer motor and closed in response to the energization of said second timer motor;

a cooking selection dial having indications of kinds of foods and cooking operations and amounts thereof and having a pointer movably linked to said change-over switches;

cooperating with said timer motors for initially setting said first and second timer motors and said first and second change-over switches in accordance with a desired cooking operation; and switch means for effecting switching of said output controlling means, said switch means being linked with said cooking selection dial and responsive to the selection of a desired cooking operation.

2. A microwave oven comprising an oven body having a heating chamber therein, a door for closing the front opening of said heating chamber, a microwave generator for supplying a microwave energy to said heating chamber, a first timer means adapted to cooperate with a power supply circuit, for applying predetermined power to the microwave generator for a first time period, which first timer means comprises:

a first timer motor for defining said first time period and two change-over switches which are controlled by said first timer motor in a manner to apply power to the microwave generator through their normal-on contacts when said first timer motor is revolving;

a second timer means, responsive to said first timer means for upon completion of said first time period, counting a second time period longer than said first period, which second timer means comprises;

a second timer motor for defining said second time period and a normal-off switch which is controlled by said second timer motor and connected between the two normal-off contacts of said two change-over switches in a manner to apply a power to said second timer motor and the microwave generator, an output controlling means for changing the level of output power of said microwave generator into two or more different levels, said output controlling means being connected substantially in parallel with one of said first timer motor and said second timer motor, a cooking selection dial having indications of kinds of foods and cookings and amounts thereof and having a pointer movably linked to the first timer means, a switch means for switching said output controlling means, said switch means being linked with said cooking selection dial in a manner to be actuated by the selection of a desired kind of cooking.

3. A microwave oven comprising an oven body having a heating chamber therein, a door for closing and electromagnetically sealing a front opening of said heating chamber, a microwave generator for supplying a microwave energy to said heating chamber, a first timer means which causes a power supply circuit to feed a power to the microwave generator for a first time period, which first timer means comprises:

a first timer motor for defining said first time period and a first change-over switch and a second change-over switch both of which are controlled by said first timer motor in a manner that their normal-off contact are closed from a time setting for said first time period, and their normal on contacts are open during said first time period, said first timer motor being connected to the power source line through said normal-off contact of said first switch, said normal-off contacts of said first change-over switch and said second change-over switch being connected in series with each other and the series connection connects said microwave generator to said power source lines, a second timer means, responsive to said first timer means, for upon completion of said first time period, counting a second time period, which second timer means comprises, a second timer motor for defining said second time period and a normal-off switch which is controlled by said second timer motor in a manner to be closed during the energization of said second timer motor, said normal-off switch connecting said second timer motor to said power source lines through a series connection of said normal-on contact of said first change-over switch and said normal-off switch and also said normal-off switch connecting said microwave generator to said power source lines through a series connection of said normal on contact of said first change-over switch, said normal-off switch and said normal-on contact of said second change-over switch, an output controlling means for changing the level of output power of said microwave generator into two or more different levels, which output controlling means are connected substantially in parallel with one of said first timer motor and said second timer motor, a cooking selection dial having indications of kinds of foods and cookings and amounts thereof and having a pointer movably linked to the first timer means, and a switch means for switching said output controlling means, said switch means being linked with said cooking selection dial in a manner to be actuated by the selection of a desired kind of cooking.

4. A microwave oven comprising an oven body having a heating chamber therein, a door for closing the front opening of said heating chamber, a microwave generator for supplying a microwave energy to said heating chamber, an output controlling means for changing the level of output power of said microwave generator into two or more different levels, a first timer means for actuating a power supply circuit to feed a power to the microwave generator for a preset first time period, a second time period means responsive to said first timer means, for upon completion of said first time period counting a second preset time, simultaneously switching said output controlling means in a manner to lower said output power of the microwave generator to a lower level and for the completion of said second time period switching off said microwave generator, a cooking selection dial having indications of kinds of foods and cookings and amounts thereof and having a pointer linked to and cooperating with the first timer means, and a switch means for switching said output controlling means, said switch means being linked with said cooking selection dial in a manner to be actuated by the selection of a desired kind of cooking.

5. A microwave oven including an oven body having a heating chamber therein, a door for closing and electromagnetically sealing a front opening of said heating chamber, a microwave generator for supplying a microwave energy to said heating chamber, a first timer means adapted to cooperate with a power supply for selectively applying a power to the microwave generator for a first time period and an output controlling means for changing the level of output power of said microwave generator into two or more different levels, characterized in that:

said first timer means comprises a first timer motor for defining said first time period and a first change-over switch and a second change-over switch both of which are controlled by said first timer motor in a manner that their normal-off contacts are closed during said first time period, and their normal on contacts are open during said first time period, said first timer motor being connected to the power switch and said second change-over switch being connected in series with each other and the series connection connecting said microwave generator to said power source, and said microwave oven including a second timer means responsive to said first timing means for upon completion of said first time period, counting a second time period, which second timer means comprises, a second timer motor for defining said second time period and a normal-off switch, controlled by said second timer motor in a manner to be closed during the energization of said second timer motor, said normal-off switch connecting said second timer motor to said power source through a series connection of said normal on contact of said first change-over switch and said normal-off switch and also said normal-off switch connecting said microwave generator to said power source through a series connection of said normal on contact of said first change-over switch, said normal-off switch and said normal-on contact of said second change-over switch, said output control means being connected substantially in parallel with one of said first timer motor and said second timer motor, a cooking selection dial having indications of kinds of foods and cookings and amounts thereof and having a pointer linked to and cooperating with the first timer means, a switch means for switching said output controlling means, said switch means being linked with said cooking selection dial in a manner to be actuated by the selection of a desired kind of cooking.

6. A microwave oven of claim 4, wherein a first and a second indication means are provided in a manner to be actuated when said first timer means and said second timer means are actuated, respectively.

7. A microwave oven of claim 6, wherein said first and second indication means are lamps of different colors.

8. A microwave oven of claim 3 which further comprises another change-over switch which changes over said output controlling means to a parallel connection with said microwave generator.

9. A microwave oven of claim 8 which further comprises indication lamps connected in parallel with said first timer motor, said second timer motor, and said microwave generator.

* * * * *